US007384538B2

(12) United States Patent
Miller

(10) Patent No.: US 7,384,538 B2
(45) Date of Patent: Jun. 10, 2008

(54) CATALYST COMBINATION FOR THE HYDROISOMERIZATION OF WAXY FEEDS AT LOW PRESSURE

(75) Inventor: Stephen J. Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 519 days.

(21) Appl. No.: 10/980,572

(22) Filed: Nov. 2, 2004

(65) Prior Publication Data

US 2006/0091043 A1 May 4, 2006

(51) Int. Cl.
*C07C 7/13* (2006.01)

(52) U.S. Cl. ..... 208/89; 208/88; 208/145; 585/734; 585/748; 585/737; 585/744

(58) Field of Classification Search ..... 208/89, 208/145; 585/734, 737
See application file for complete search history.

(56) References Cited

U.S. PATENT DOCUMENTS 5,135,638 A 8/1992 Miller, I
5,149,421 A 9/1992 Miller, II
5,282,958 A 2/1994 Santilli et al.
5,543,035 A 8/1996 Ziemer
6,051,129 A 4/2000 Harris et al.
6,187,725 B1 2/2001 Kramer et al.
6,441,263 B1 8/2002 O'Rear, I et al.
6,562,230 B1 5/2003 O'Rear, II et al.

*Primary Examiner*—Tam M. Nguyen
(74) *Attorney, Agent, or Firm*—A. Stephen Zavell; James W. Ambrosius

(57) ABSTRACT

A process for the hydroisomerization of a waxy feed having a major portion boiling above 650° F. to produce a lubricating base oil having a lower pour point, said process comprising (a) passing the waxy feed along with hydrogen gas through a hydroisomerization zone maintained at a hydrogen partial pressure of between about 100 psia and about 400 psia, said hydroisomerization zone comprising a catalyst bed containing at least two active wax hydroisomerization catalysts, said catalysts comprising at least (i) a first catalyst comprising an active hydrogenation component and a 1-D, 10-ring molecular sieve having a maximum crystallographic free diameter of the channels equal to 6.2 Å units or greater and (ii) a second catalyst comprising an active hydrogenation component and a 1-D, 10-ring molecular sieve having a maximum crystallographic free diameter of the channels equal to 5.8 Å units or less, wherein the weight ratio of molecular sieve contained in the first catalyst to the molecular sieve contained in second catalyst in the hydroisomerization zone falls within the range between about 2 to 1 and about 12 to 1; and (b) recovering from the hydroisomerization zone a lubricating base oil having a lower pour point as compared to the waxy feed.

31 Claims, No Drawings

CATALYST COMBINATION FOR THE HYDROISOMERIZATION OF WAXY FEEDS AT LOW PRESSURE

FIELD OF THE INVENTION

The present invention relates to a process for the low pressure hydroisomerization of waxy feeds to produce lubricating base oils.

BACKGROUND OF THE INVENTION

Finished lubricants used for automobiles, diesel engines, axles, transmissions, and industrial applications consist of two general components, a lubricating base oil and additives. Lubricating base oil is the major constituent in these finished lubricants and contributes significantly to the properties of the finished lubricant. In general, a few lubricating base oils are used to manufacture a wide variety of finished lubricants by varying the mixtures of individual lubricating base oils and individual additives.

Lubricating base oils are usually prepared from hydrocarbon feedstocks having a major portion boiling above 650° F. Typically, the feedstocks from which lubricating base oils are prepared are recovered as part of the bottoms from an atmospheric distillation unit. This high boiling bottoms material may be further fractionated in a vacuum distillation unit to yield cuts with pre-selected boiling ranges. Most lubricating base oils are prepared from that fraction or fractions where a major portion boils above about 700° F. and below about 1050° F.

Although lubricating base oils traditionally have been prepared from conventional petroleum feedstocks, recent studies have shown that high quality lubricating base oils can be prepared from unconventional waxy feedstocks, such as from slack wax and Fischer-Tropsch wax. Since these unconventional waxy feedstocks are primarily composed of normal paraffins, these feedstocks initially have poor low temperature properties, such as pour point and cloud point. In order to improve the low temperature properties of the waxy feedstocks, selective branching must be introduced into the hydrocarbon molecules, as for example, through hydroisomerization. See, for example U.S. Pat. Nos. 5,135,638; 5,543,035; and 6,051,129. While hydroisomerization may be used to produce premium lubricating base oils from waxy feedstocks, the process conditions at which the reactor must be operated also results in considerable cracking. Cracking of the hydrocarbon molecules during the hydroisomerization operation results in a significant yield loss among those hydrocarbons boiling in the range of lubricating base oil. At the same time cracking increases the yield of lower boiling hydrocarbons, such as diesel and naphtha, which are of lower commercial value. Operating under less severe conditions, as for example at lower pressure, results in less cracking and higher yields of lubricating base oils. However, operating at lower pressures also results in accelerated deactivation of the catalyst which significantly shortens the run life of the hydroisomerization catalyst. The present invention is directed to a hydroisomerization process using a novel catalyst combination which allows the hydroisomerization reactor to be operated at a low hydrogen partial pressure without the typical deactivation problem associated with low pressure operation. This translates into longer catalyst run life while at the same time achieving less cracking and higher lubricating base oil yields.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

BRIEF DESCRIPTION OF THE INVENTION

The present invention is directed to a process for the hydroisomerization of a waxy feed having a major portion boiling above 650° F. to produce a lubricating base oil having a lower pour point, said process comprising (a) passing the waxy feed along with hydrogen gas through a hydroisomerization zone maintained at a hydrogen partial pressure of between about 100 psia and about 400 psia, said hydroisomerization zone comprising a catalyst bed containing at least two active wax hydroisomerization catalysts, said catalysts comprising at least (i) a first catalyst comprising an active hydrogenation component and a 1-D, 10-ring molecular sieve having a maximum crystallographic free diameter of the channels equal to 6.2 Å units or greater and (ii) a second catalyst comprising an active hydrogenation component and a 1-D, 10-ring molecular sieve having a maximum crystallographic free diameter of the channels equal to 5.8 Å units or less, wherein the weight ratio of the molecular sieve contained in the first catalyst to the molecular sieve contained in the second catalyst in the hydroisomerization zone falls within the range between about 2 to 1 and about 12 to 1; and (b) recovering from the hydroisomerization zone a lubricating base oil having a lower pour point as compared to the waxy feed. The process of the invention is suitable for use with waxy feeds derived from either conventional petroleum feedstocks, such as slack wax, or synthetic feedstocks, such as Fischer-Tropsch wax. The term "waxy feed" refers to feedstocks containing significant amounts of n-paraffins or slightly branched paraffins. Waxy feeds typically will contain greater than about 40 wt. % normal paraffins, preferably greater than about 50 wt. % normal paraffins, and more preferably greater than 75 wt. % normal paraffins.

The first and second catalysts may be in form of an admixture of the catalyst particles within the hydroisomerization zone, but preferably the catalysts will be present in separate discrete layers within a fixed catalyst bed. Consequently, the invention may also be described as a process for the hydroisomerization of a waxy feed having a major portion boiling above 650° F. to produce a lubricating base oil having a lower pour point, said process comprising (a) passing the waxy feed along with hydrogen gas through a hydroisomerization zone maintained at a hydrogen partial pressure of between about 100 psia and about 400 psia, said hydroisomerization zone comprising a fixed catalyst bed containing at least two catalyst layers, said catalyst layers comprising at least (i) a first catalyst layer containing an active wax hydroisomerization catalyst comprising an active hydrogenation component and a 1-D, 10-ring molecular sieve having a maximum crystallographic free diameter of the channels equal to 6.2 Å units or greater and (ii) a second catalyst layer containing an active wax hydroisomerization catalyst comprising an active hydrogenation component and a 1-D, 10-ring molecular sieve having a maximum crystallographic free diameter of the channels equal to 5.8 Å units or less, wherein the weight ratio of the molecular sieve present in the first catalyst layer to the molecular sieve present in the second catalyst layer falls within the range between about 2 to 1 and about 12 to 1; and (b) recovering from the hydroisomerization zone a lubricating base oil having a lower pour point as compared to the waxy feed. It should be noted that the catalyst bed may contain more than two layers provided that the ratio between the molecular sieves in each catalyst layer falls within the critical range.

Both the first and second catalysts used in carrying out the invention contain 1-D, 10-ring molecular sieves. A 1-D molecular sieve refers to a molecular sieve having parallel intra-crystalline channels which are not interconnected. Such channels are conventionally referred to as 1-D diffusion types or simply 1-D pores. A 10-ring molecular sieve refers to the number of oxygen atoms which make up the framework surrounding the pore aperture. The two molecular sieves used in catalysts of the invention differ from each other in their respective effective pore size as it is measured across the major axis of the pore. In addition to the molecular sieve, the first and second catalysts used in the process will also contain an active hydrogenation component, such as a Group VIII metal, preferably platinum used either alone or in combination with another active metal. Usually the catalyst will also include a matrix support which comprises a refractory oxide such as silica or alumina.

The first catalyst used alone, generally gives a higher lubricating base oil yield at low pressure than the second catalyst used alone. The first catalyst also deactivates more readily than the second catalyst. The combination of catalysts used in the present invention makes low pressure operation of the first hydroisomerization catalyst practical by extending the run life of that catalyst in the hydroisomerization zone. Although hydroisomerization will proceed over a wide pressure range, prior to the present invention operation using a hydroisomerization catalyst having high conversion and selectivity below a hydrogen partial pressure of about 400 psia usually resulted in accelerated catalyst deactivation. The present invention allows operation below a hydrogen partial pressure of 400 psia with greatly reduced catalyst deactivation while surprisingly retaining minimal cracking selectivity. Operation at these low pressures results in improved yields for those lubricating base oils boiling within the 700° F. to 1050° F. range.

DETAILED DESCRIPTION OF THE INVENTION

Feeds used to prepare the lubricating base oils according to the process of the invention are waxy feeds, i.e., a feed containing at least 40 wt. % normal paraffins, preferably at least 50 wt. % normal paraffins, and most preferably at least 75 wt. % normal paraffins. The waxy feed may be a conventional petroleum derived feed, such as, for example, slack wax, or it may be derived from a synthetic feed, such as, for example, a feed prepared from a Fischer-Tropsch synthesis. A major portion of the feed should boil above 650° F. Preferably, at least 80 wt. % of the feed will boil above 650° F., and most preferably at least 90 wt. % will boil above 650° F. Highly paraffinic feeds used in carrying out the invention typically will have an initial pour point above 0° C., more usually above 10° C.

Slack wax can be obtained from conventional petroleum derived feedstocks by either hydrocracking or by solvent refining of the lube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Optionally, hydrotreating of the slack wax can be used to lower the nitrogen content. Slack waxes posses a very high viscosity index, normally in the range of from about 140 to 200, depending on the oil content and the starting material from which the slack wax was prepared. Therefore, slack waxes are suitable for the preparation of lubricating base oils having a very high viscosity index.

Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into lubricating base oil. Accordingly, Fischer-Tropsch wax represents an excellent feed for preparing high quality lubricating base oils according to the process of the invention. Fischer-Tropsch wax is normally solid at room temperature and, consequently, displays poor low temperature properties, such as pour point and cloud point. However, following hydroisomerization of the wax using the process described herein, good yields of Fischer-Tropsch derived lubricating base oils having excellent low temperature properties may be prepared. As used in this disclosure the phrase "Fischer-Tropsch derived" refers to a hydrocarbon stream in which a substantial portion, except for added hydrogen, is derived from a Fischer-Tropsch process regardless of subsequent processing steps. Accordingly, a "Fischer-Tropsch derived waxy feed" refers to a hydrocarbon product containing at least 40 wt. % n-paraffins which was initially derived from the Fischer-Tropsch process.

A general description of the hydroisomerization process may be found in U.S. Pat. Nos. 5,135,638 and 5,282,958. Hydroisomerization is intended to improve the cold flow properties of the lubricating base oils by the selective addition of branching into the molecular structure. Hydroisomerization ideally will achieve high conversion levels of the wax to non-waxy iso-paraffins while at the same time minimizing the conversion by cracking to lower molecular weight products. Since wax conversion can be complete, or at least very high, this process typically does not need to be combined with additional dewaxing processes to produce a high boiling product with an acceptable pour point. In preparing lubricating base oils, usually the wax is partially isomerized to a pre-selected property, such as pour point, cloud point, kinematic viscosity, etc. Generally, when preparing lubricating base oils from a waxy feed, pour point is the pre-selected target property. A lubricating base oil should have a pour point of −9° C. or lower. Preferably, the pre-selected pour point for the lubricating base oil will be −15° C. or lower. Even more preferably the pre-selected pour point will be −25° C. or lower.

In the hydroisomerization process, hydrogen gas is added to the hydroisomerization zone. In conventional hydroisomerization operations where catalysts having high selectivity and conversion rates are employed, the hydrogen partial pressure in the hydroisomerization zone is maintained above 400 psia, typically above 500 psia, in order to reduce coking of the catalyst and extend catalyst life. In the present invention, the hydroisomerization process is carried at a hydrogen partial pressure of between about 100 psia and 400 psia, preferably at a hydrogen partial pressure of between about 150 psia and about 300 psia. The temperature in the hydroisomerization zone is typically maintained within the range of from about 400° F. to about 750° F., preferably between about 550° F. and about 730° F. The liquid hourly space velocity (LHSV) is generally within the range from about 0.1 to about 10, preferably between about 0.3 to about 4.

In carrying out the process of the invention, at least two different 1-D, 10-ring molecular sieves having wax hydroisomerization activity are used in the hydroisomerization zone. The two molecular sieves differ from one another in their pore sizes. For convenience the molecular sieves will be referred to in this disclosure as the first molecular sieve and the second molecular sieve. Both the first and second molecular sieves must have hydroisomerization activity. A molecular sieve having wax hydroisomerization activity refers to a molecular sieve which may be used to catalyze the hydroisomerization reaction of the waxy feed under the reaction conditions present in the hydroisomerization zone. Hydroisomerization activity refers to both the conversion ability of the catalyst and its selectivity. In general, the first molecular sieve, i.e., the molecular sieve having the larger pore size has somewhat less hydroisomerization activity and a higher fouling rate than the second molecular sieve, i.e., the molecular sieve having the smaller pore size.

The first molecular sieve has a maximum crystallographic free diameter of the channels equal to 6.2 Å units or greater. Molecular sieves falling within the scope of the definition for the first molecular sieve include AEL framework types as described in "Atlas of Zeolite Framework Types", Fifth Revised Edition, 2001, by Ch. Baerlocher, W. M. Meier, and D. H. Olsen, Elsevier. Typical molecular sieves having the AEL framework include AlPO-11, SAPO-11, MnAPO-11, and SM-3. Particularly preferred as the first molecular sieve for carrying out the process are the AEL molecular sieves SAPO-11 and SM-3.

The second molecular sieve has a maximum crystallographic free diameter of the channels equal to 5.8 Å units or less. Molecular sieves falling within the scope of the definition for the second molecular sieve include TON and MTT framework types as described in "Atlas of Zeolite Framework Types" and also ZSM-48. Molecular sieves having the MTT and ZSM48 frameworks are preferred for use as the second molecular sieve. Typical molecular sieves having the TON framework include Theta-1, ZSM-22, NU-10, ISI-1, and KZ-2. Typical MTT molecular sieves include ZSM-23, EU-13, ISI-4, KZ-1, and SSZ-32. Particularly preferred as the second molecular sieve for carrying out the process described herein is the MTT molecular sieve SSZ-32.

In addition to the molecular sieves described above, the catalysts used in the process of the invention will also contain a hydrogenation component. The hydrogenation component comprises an active hydrogenation metal or mixture of one or more metals having hydrogenation activity. Typical active hydrogenation metals include Group VIII metals, such as, Ru, Rh, Pd, Os, Ir, and Pt. The metals platinum and palladium are especially preferred as the active metals, with platinum most commonly used. When Group VIII metals are present they are usually present in the range from about 0.01 to about 10 wt. %, preferably from about 0.1 wt. % to about 2 wt. %. The hydrogenation component may also include other catalytically active metals, such as, molybdenum, nickel, vanadium, cobalt, tungsten, and zinc. The amount of base metals present in the catalyst ranges from about 2 wt. % to about 30 wt. %. The techniques of introducing the active metals into the molecular sieve are disclosed in the literature and well known to those skilled in the art. Such techniques include ion exchange, impregnation, and occlusion. Suitable techniques are taught in greater detail in U.S. Pat. Nos. 3,236,763; 3,226,339; 3,236,762; 3,620,960; 3,373,109; 4,202,996; 4,440,781; and 4,710,485.

In addition to the molecular sieve and the hydrogenation component, the first and second catalysts employed in the process of the invention, usually will also include a refractory oxide support. The refractory oxide support may be selected from those oxide supports conventionally used in preparing catalysts, such as, for example, silica, alumina, silica-alumina, magnesia, titania, and combinations thereof. Non-acidic supports such as alumina and silica are preferred.

In carrying out the present invention, the weight ratio of the molecular sieve contained in the first catalyst to the molecular sieve contained in the second catalyst in the hydroisomerization zone will fall within the range of from about 2 to 1 to about 12 to 1, more preferably from about 3 to 1 to about 6 to 1. The first and second catalyst may be present as a mixture of particles within the hydrogenation zone. However, it is preferred that the two catalysts be distributed within the hydroisomerization zone in separate discrete layers. In such a distribution, the hydroisomerization zone will contain at least two catalyst layers, but more than two catalyst layers may be present if desired. It is preferred that the waxy feed contact the first catalyst, i.e., the catalyst containing the larger pore molecular sieve, prior to contacting the second catalyst, i.e., the catalyst containing the smaller pore molecular sieve.

While not wishing to be bound to any particular theory, it is believed that during hydroisomerization the larger pore molecular sieve partially hydroisomerizes the waxy feed while the smaller pore molecular sieve completes the conversion. The larger pore molecular sieve is able to operate at lower pressures with reduced coking due to lower conversion. The larger pore molecular sieve enables the user to benefit from its high isomerization selectivity at lower pressure. The smaller pore molecular sieve has a lower fouling rate and greater hydroisomerization activity, but when used alone has poorer isomerization selectivity due to greater cracking to lower boiling products. With the present invention, it is theorized that the waxy feed is already partially hydroisomerized prior to contacting the smaller pore molecular sieve, therefore, the smaller pore molecular sieve does not have to do as much conversion, and, consequently, less cracking takes place. What is particularly surprising is that the present invention not only results in an increase in catalyst life as compared to running the larger pore molecular sieve alone but the yield of desirable lubricating base oil is only slightly reduced from hydroisomerization reactions carried out using only the more selective catalyst containing the larger pore molecular sieve.

The lubricating base oil prepared using the present invention usually may be further fractionated into two or more lube cuts, each falling within a specified boiling range. Generally, the base oil or base oil cuts which boil within the range of from about 700° F. to about 1050° F. are the lubricating base oils used to prepare a wide variety of finished lubricants including automatic transmission fluids and engine oils. Therefore, the hydroisomerization process is typically operated under conditions designed to meet a target property, such as pour point, for the lubricating base oil products boiling within this range. Lubricating base oils prepared according to the present invention will typically have a pour point no higher than −9° C. Preferably, lubricating base oil used to prepare a finished engine oil lubricant will have a pour point of −15° C. or lower, preferably −25° C. or lower. Other properties which may be selected as targets in preparing lubricating base oil include, but are not necessarily limited to, cloud point, kinematic viscosity, Noack volatility, and viscosity index.

The following examples are intended to further illustrate the invention but are not intended to be a limitation thereon.

EXAMPLES

Example 1

Determination of normal paraffins (n-paraffins) in wax-containing samples should use a method that can determine the content of individual $C_7$ to $C_{110}$ n-paraffins with a limit of detection of 0.1 wt. %. The preferred method used is as follows.

Quantitative analysis of normal paraffins in wax is determined by gas chromatography (GC). The GC (Agilent 6890 or 5890 with capillary split/splitless inlet and flame ionization detector) is equipped with a flame ionization detector, which is highly sensitive to hydrocarbons. The method utilizes a methyl silicone capillary column, routinely used to separate hydrocarbon mixtures by boiling point. The column is fused silica, 100% methyl silicone, 30 meters length, 0.25 mm ID, 0.1 micron film thickness supplied by Agilent. Helium is the carrier gas (2 ml/min) and hydrogen and air are used as the fuel to the flame.

The waxy feed is melted to obtain a 0.1 g homogeneous sample. The sample is immediately dissolved in carbon disulfide to give a 2 wt. % solution. If necessary, the solution is heated until visually clear and free of solids, and then injected into the GC. The methyl silicone column is heated using the following temperature program:

| | |
|---|---|
| Initial temp: | 150° C. (If $C_7$ to $C_{15}$ hydrocarbons are present, the initial temperature is 50° C.) |
| Ramp: | 6° C. per minute |
| Final Temp: | 400° C. |
| Final hold: | 5 minutes or until peaks no longer elute |

The column then effectively separates, in the order of rising carbon number, the normal paraffins from the non-normal paraffins. A known reference standard is analyzed in the same manner to establish elution times of the specific n-paraffin peaks. The standard is ASTM D2887 n-paraffin standard, purchased from a vendor (Agilent or Supelco), spiked with 5 wt. % Polywax 500 polyethylene (purchased from Petrolite Corporation in Oklahoma). The standard is melted prior to injection. Historical data collected from the analysis of the reference standard also guarantees the resolving efficiency of the capillary column.

If present in the sample, n-paraffin peaks are well separated and easily identifiable from other hydrocarbon types present in the sample. Those peaks eluting outside the retention time of the normal paraffins are called non-normal paraffins. The total sample is integrated using baseline hold from start to end of run. N-paraffins are skimmed from the total area and are integrated from valley to valley. All peaks detected are normalized to 100%. EZChrom is used for the peak identification and calculation of results.

Example 2

A hydrotreated Fischer-Tropsch wax having the following inspections was used in this Example 2 and in following Example 3:

| Inspections of Hydrotreated Fischer-Tropsch Wax | |
|---|---|
| Gravity, API | 41.6 |
| Simulated Distillation, wt. %, ° F. | |
| ST/5 | 450/573 |
| 10/30 | 627/715 |
| 50 | 791 |
| 70/90 | 871/961 |
| 95/EP | 999/1107 |

The hydrotreated Fischer-Tropsch wax was hydroisomerized at 1 LHSV and 5 MSCF/bbl of hydrogen gas to a −28° C. pour point over different commercially available catalysts and catalyst combinations present as a layered system within the hydroisomerization zone. Catalyst A contained platinum on a 85 wt. % SM-3 type molecular sieve extrudate with an alumina binder and Catalyst B contained platinum on a 65 wt. % SSZ-32 type molecular sieve extrudate with an alumina binder.

The results are shown in the following Table:

TABLE

| | Catalyst | | | |
|---|---|---|---|---|
| | 3/1 Ratio* Cat. A/Cat. B | 3/1 Ratio* Cat. A/Cat. B | Cat. B | Cat. A |
| Total Pressure, psig | 300 | 150 | 300 | 300 |
| SOR**, ° F. | 615 | 599 | 599 | 639 |
| Yields, Wt % | | | | |
| 650-750° F. | 17.2 | 17.8 | 17.1 | 25.9 |
| 750-950° F. | 31.5 | 32.2 | 28.4 | 31.6 |
| 950° F. plus | 12.9 | 13.8 | 11.5 | 11.3 |
| 700-1050° F. | 49 | 49.7 | 43.7 | 50.4 |
| Deltas vs. Cat. A | | | | |
| SOR**, ° F. | −24 | −40 | −40 | |
| X Life*** | >3 | 1 | >3 | |
| Yields, Wt % | | | | |
| 650-750° F. | −8.7 | −8.1 | −8.8 | |
| 750-950° F. | −0.1 | 0.6 | −3.2 | |
| 950° F. plus | −1.6 | −2.5 | 0.2 | |
| 700-1050° F. | −1.4 | −0.7 | −6.7 | |

*Ratio represents volume to volume ratio.
**SOR refers to start of run temperature.
***X Life refers to catalyst life. A factor of 3 means the catalyst will run 3 times as long at the same operating conditions, i.e., have one-third the fouling rate.

Note that the layered system provides nearly the same yield of 700 to 1050° F. lubricating base oil as Catalyst A alone but with much better activity as demonstrated by the lower start temperature. Also note that stability at 300 psig for the layered system is much better which allows for much better catalyst life.

Example 3

A layered system containing a 3 to 1 weight ratio of Catalyst A to Catalyst B was compared to a similar system in which the catalysts were mixed. Each catalyst system was placed on-stream for approximately 300 hours. The same Fischer-Tropsch wax used in Example 2 was hydroisomerized to a −28° C. pour point using each system at 300 psig, 1 LHSV, and 5 MSCF/bbl of hydrogen gas. The weight percent yield of 700 to 1050° F. product was compared and found to be:

| | |
|---|---|
| Layered system | 48.9 wt. % |
| Mixed | 47.0 wt. % |

The viscosity index (VI) of the 650° F. plus product made from the layered and mixed systems was tested and found to be:

| | |
|---|---|
| Layered system | 167 |
| Mixed | 162 |

Although both systems performed better than a single catalyst system under the same conditions, it should be noted that the layered system gave a higher yield of the desirable 700 to 1050° F. product, and the 650° F. plus product had a higher VI.

What is claimed is:

1. A process for the hydroisomerization of a waxy feed having a major portion boiling above 650° F. to produce a lubricating base oil having a lower pour point, said process comprising:

(a) passing the waxy feed along with hydrogen gas through a hydroisomerization zone maintained at a hydrogen partial pressure of between about 100 psia and about 400 psia, said hydroisomerization zone comprising a catalyst bed containing at least two active wax hydroisomerization catalysts, said catalysts comprising at least (i) a first catalyst comprising an active hydrogenation component and a 1-D, 10-ring molecular sieve having a maximum crystallographic free diameter of the channels equal to 6.2 Å units or greater and (ii) a second catalyst comprising an active hydrogenation component and a 1-D, 10-ring molecular sieve having a maximum crystallographic free diameter of the channels equal to 5.8 Å units or less, wherein the weight ratio of the molecular sieve contained in the first catalyst to the molecular sieve contained in the second catalyst in the hydroisomerization zone falls within the range between about 2 to 1 and about 12 to 1; and (b) recovering from the hydroisomerization zone a lubricating base oil having a lower pour point as compared to the waxy feed.

2. The process of claim 1 wherein the waxy feed is slack wax.

3. The process of claim 1 wherein the waxy feed is derived from a Fischer-Tropsch synthesis.

4. The process of claim 1 wherein the hydrogen partial pressure in the hydroisomerization zone falls within the range from about 150 psia and about 300 psia.

5. The process of claim 1 wherein the molecular sieve contained in the first catalyst is an AEL framework type molecular sieve.

6. The process of claim 5 wherein the AEL framework type molecular sieve is SAPO-11.

7. The process of claim 5 wherein the AEL framework type molecular sieve is SM-3.

8. The process of claim 1 wherein the second catalyst contains a molecular sieve selected from the group consisting of a TON framework type molecular sieve, an MTT framework type molecular sieve, and ZSM-48.

9. The process of claim 8 wherein the molecular sieve is an MTT framework type molecular sieve.

10. The process of claim 9 wherein the MTT framework type molecular sieve is SSZ-32.

11. The process of claim 1 wherein the weight ratio of the molecular sieve contained in the first catalyst to the molecular sieve contained in the second catalyst in the hydroisomerization zone falls within the range between about 3 to 1 and about 6 to 1.

12. The process of claim 1 wherein a lubricating base oil fraction recovered from the hydroisomerization zone has a boiling range between about 700° F. and about 1050° F.

13. The process of claim 12 wherein the lubricating base oil fraction having a boiling range between about 700° F. and about 1050° F. has a pour point of −9° C. or lower.

14. The process of claim 12 wherein the lubricating base oil fraction having a boiling range between about 700° F. and about 1050° F. has a pour point of −15° C. or lower.

15. The process of claim 14 wherein the lubricating base oil fraction having a boiling range between about 700° F. and about 1050° F. has a pour point of −25° C. or lower.

16. The process of claim 1 wherein the hydroisomerization zone contains a fixed catalyst bed wherein the first catalyst and the second catalyst are contained in separate layers.

17. A process for the hydroisomerization of a waxy feed having a major portion boiling above 650° F. to produce a lubricating base oil having a lower pour point, said process comprising:

(a) passing the waxy feed along with hydrogen gas through a hydroisomerization zone maintained at a hydrogen partial pressure of between about 100 psia and about 400 psia, said hydroisomerization zone comprising a fixed catalyst bed containing at least two catalyst layers, said catalyst layers comprising at least (i) a first catalyst layer containing an active wax hydroisomerization catalyst comprising an active hydrogenation component and a 1-D, 10-ring molecular sieve having a maximum crystallographic free diameter of the channels equal to 6.2 Å units or greater and (ii) a second catalyst layer containing an active wax hydroisomerization catalyst comprising an active hydrogenation component and a 1-D, 10-ring molecular sieve having a maximum crystallographic free diameter of the channels equal to 5.8 Å units or less, wherein the weight ratio of molecular sieve present in the first catalyst layer to the molecular sieve present in the second catalyst layer falls within the range between about 2 to 1 and about 12 to 1; and (b) recovering from the hydroisomerization zone a lubricating base oil having a lower pour point as compared to the waxy feed.

18. The process of claim 17 wherein the waxy feed is slack wax.

19. The process of claim 17 wherein the waxy feed is derived from a Fischer-Tropsch synthesis.

20. The process of claim 17 wherein the hydrogen partial pressure in the hydroisomerization zone falls within the range from about 150 psia and about 300 psia.

21. The process of claim 17 wherein the molecular sieve in the first catalyst layer is an AEL framework type molecular sieve.

22. The process of claim 21 wherein the AEL framework type molecular sieve is SAPO-11.

23. The process of claim 21 wherein the AEL framework type molecular sieve is SM-3.

24. The process of claim 17 wherein the molecular sieve in the second layer is selected from the group consisting of a TON framework type molecular sieve, an MTT framework type molecular sieve, and ZSM-48.

25. The process of claim 24 wherein the molecular sieve in the second catalyst layer is an MTT framework type molecular sieve.

26. The process of claim 25 wherein the MTT framework type molecular sieve is SSZ-32.

27. The process of claim 17 wherein the weight ratio of the molecular sieve contained in the active wax hydroisomerization catalyst in the first catalyst layer to the molecular sieve contained in the active wax hydroisomerization catalyst in the second catalyst layer of the hydroisomerization zone falls within the range between about 3 to 1 and about 6 to 1.

28. The process of claim 17 wherein a lubricating base oil fraction recovered from the hydroisomerization zone has a boiling range between about 700° F. and about 1050° F.

29. The process of claim 28 about 700° F. and about 1050° F. has a pour point of −9° C. or lower.

30. The process of claim 29 about 700° F. and about 1050° F. has a pour point of −15° C. or lower.

31. The process of claim 30 wherein the lubricating base oil fraction having a boiling range between about 700° F. and about 1050° F. has a pour point of −25° C. or lower.

* * * * *